US008654060B2

(12) United States Patent
Chen et al.

(10) Patent No.: US 8,654,060 B2
(45) Date of Patent: Feb. 18, 2014

(54) PROCESSING DEVICE AND PROCESSING METHOD OF HIGH DYNAMIC CONTRAST FOR LIQUID CRYSTAL DISPLAY APPARATUS

(75) Inventors: Ming Chen, Beijing (CN); Hyungdae Kim, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 571 days.

(21) Appl. No.: 12/128,686

(22) Filed: May 29, 2008

(65) Prior Publication Data

US 2009/0079688 A1 Mar. 26, 2009

(30) Foreign Application Priority Data

Sep. 21, 2007 (CN) ..... 2007 1 0122164

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 6,480,180 | B1 | 11/2002 | Moon | |
| 7,443,377 | B2 * | 10/2008 | Kim | 345/102 |
| 7,847,771 | B2 * | 12/2010 | Maruyama et al. | 345/89 |
| 2002/0011979 | A1 * | 1/2002 | Nitta et al. | 345/89 |
| 2002/0163490 | A1 * | 11/2002 | Nose | 345/89 |
| 2004/0257329 | A1 * | 12/2004 | Park et al. | 345/102 |

(Continued)

FOREIGN PATENT DOCUMENTS

| | | |
|---|---|---|
| CN | 1661663 A | 8/2005 |
| CN | 1912963 | 2/2007 |

(Continued)

OTHER PUBLICATIONS

English Abstract of KR2007-0094371 dated Sep. 20, 2007.
English abstract of CN 1912963 dated Feb. 14, 2007.
Zhiyong Wei, "Driving Circuit Design of TFT Liquid Crystal Module," Database for China Excellent Dissertation for Doctor and Master Degree, Information Technology Edition, Master Degree Part. Dec. 15, 2006, pp. 15-23, 2006.

(Continued)

*Primary Examiner* — William Boddie
*Assistant Examiner* — Sahlu Okebato
(74) *Attorney, Agent, or Firm* — Ladas & Parry LLP

(57) ABSTRACT

This invention relates to a processing device and processing method of high dynamic contrast for liquid crystal display apparatus, the processing device comprises a receiver, an inverter, and a source driving IC connected with a central processing module. The processing method includes: performing a histogram statistical process on received low voltage Differential Signaling data; obtaining a backlight source dimming coefficient and a Gamma reference voltage parameter of the same frame of picture according to the result of the histogram statistical process. controlling the brightness of the backlight source according to said backlight source dimming coefficient; controlling the voltage of the pixel capacitor on the liquid crystal panel according to said Gamma reference voltage parameter. This invention respectively adjusts the brightness of the backlight source and the voltage of the pixel capacitor of the liquid crystal panel simultaneously, and hence the dynamic contrast of the picture is increased, the problems of lower contrast and flicker of TFT liquid crystal display apparatus are ameliorated, and the power consumption of the backlight source is saved.

10 Claims, 5 Drawing Sheets

(56) References Cited

U.S. PATENT DOCUMENTS

| | | | | |
|---|---|---|---|---|
| 2005/0001801 | A1 | 1/2005 | Kim | |
| 2005/0104837 | A1* | 5/2005 | Baik et al. | 345/99 |
| 2005/0104839 | A1* | 5/2005 | Baik | 345/102 |
| 2005/0104840 | A1 | 5/2005 | Sohn et al. | |
| 2005/0140640 | A1* | 6/2005 | Oh et al. | 345/102 |
| 2006/0055660 | A1 | 3/2006 | Teranishi | |
| 2006/0119613 | A1* | 6/2006 | Kerofsky | 345/590 |
| 2006/0125812 | A1* | 6/2006 | Lee | 345/204 |
| 2006/0209005 | A1 | 9/2006 | Pedram et al. | |
| 2006/0221046 | A1 | 10/2006 | Sato et al. | |
| 2007/0018951 | A1* | 1/2007 | Nobori et al. | 345/156 |
| 2007/0097069 | A1* | 5/2007 | Kurokawa et al. | 345/102 |
| 2007/0176879 | A1 | 8/2007 | Makino et al. | |
| 2008/0068328 | A1* | 3/2008 | Jou et al. | 345/102 |
| 2008/0117162 | A1* | 5/2008 | Song et al. | 345/102 |
| 2008/0266331 | A1 | 10/2008 | Chen et al. | |
| 2009/0066632 | A1 | 3/2009 | Chen | |
| 2009/0079688 | A1 | 3/2009 | Chen et al. | |

FOREIGN PATENT DOCUMENTS

| | | | |
|---|---|---|---|
| CN | 1949353 | A | 4/2007 |
| JP | 2002-31846 | A | 1/2002 |
| JP | 2005-148709 | A | 6/2005 |
| JP | 2006-154064 | A | 6/2006 |
| JP | 2006-276677 | A | 10/2006 |
| JP | 2007-11350 | A | 1/2007 |
| KR | 2004-57882 | | 7/2004 |
| KR | 2007-24185 | | 3/2007 |
| KR | 2007-0094371 | | 9/2007 |
| WO | 2006/038253 | A | 4/2006 |

OTHER PUBLICATIONS

An Office Action dated Jul. 26, 2011 for U.S. Appl. No. 12/061,392.
An Office Action dated May 17, 2011 for U.S. Appl. No. 12/061,392.
An Office Action dated Jan. 14, 2011 for U.S. Appl. No. 12/061,392.
English abstract of CN 1661663 A.
An Office Action dated Dec. 17, 2010 for U.S. Appl. No. 12/126,050.
English abstract of CN 1949353 A.
An Office Action dated Mar. 30, 2011 for U.S. Appl. No. 12/126,050.
An Advisory Action dated Jun. 13, 2011 for U.S. Appl. No. 12/126,050.
English abstract of KR 2004-57882.
English abstract of KR 2007-24185.
An Office Action dated Jul. 12, 2011 for U.S. Appl. No. 12/126,050.
USPTO OA mailed Oct. 18, 2011 in connection with U.S. Appl. No. 12/061,392.
USPTO FOA mailed Dec. 29, 2011 in connection with U.S. Appl. No. 12/126,050.
Office Action dated May 18, 2012 for U.S. Appl. No. 12/061,392.
USPTO NFOA mailed Sep. 26, 2012 in connection with U.S. Appl. No. 12/061,392.
USPTO NFOA mailed Jul. 30, 2012 in connection with U.S. Appl. No. 12/126,050.
Office Action dated Jan. 25, 2013 for U.S. Appl. No. 12/061,392.
Office Action dated Jan. 30, 2013 for U.S. Appl. No. 12/126,050.

* cited by examiner

PROCESSING DEVICE AND PROCESSING METHOD OF HIGH DYNAMIC CONTRAST FOR LIQUID CRYSTAL DISPLAY APPARATUS

FIELD OF THE INVENTION

This invention relates to a digital image processing device and processing method for liquid crystal display apparatus, and particularly, to a processing device and processing method of high dynamic contrast for liquid crystal display apparatus.

BACKGROUND ART

As the increasing maturation and decreasing cost in the technology, Thin Film Transistor (TFT) liquid crystal display and TFT liquid crystal TV have gradually replaced the dominant position of the conventional CRT in the display field. As compared with CRT display, TFT liquid crystal display apparatus has the advantages of low radiation, low power consumption, small volume, etc. However, TFT liquid crystal display apparatus has the disadvantages of lower brightness and contrast, especially in displaying dark pictures, the sense of layers is decreased due to the presence of Gamma curve.

As for this problem, the prior art has proposed a Dynamic Gamma Control (DGC) solution. The main design idea of DGC is that: increasing the brightness difference among the dominant gray scales in a manner of changing Gamma voltage, thus increasing the contrast of picture. The concrete way is that: firstly, the Low Voltage Differential Signaling (LVDS) data received from the receiver is subjected to a histogram statistics, and then is subjected to a Gamma reference voltage processing according to the result of the histogram statistics, so as to increase the dynamic range of the gray scale voltage with more distribution and decrease the dynamic range of the gray scale voltage with less distribution, thus enhancing the contrast of the dominant gray scales in picture and increasing the contrast of picture. In practice, it is shown that DGC solution has the technical problems as follows:

(1) The brightness is increased with the increasing of the contrast, the unnecessary brightness increases the power consumption of the backlight source, thus increasing the power consumption of the product;

(2) When the continuous pictures display the brightness and the darkness alternatively, or the pictures become bright or dark suddenly, human eyes would feel the flicker of picture.

SUMMARY OF THE INVENTION

An object of this invention is to provide a backlight source control based processing device and processing method of high dynamic contrast for liquid crystal display apparatus, said processing device and processing method increase the dynamic contrast and quality of the picture, solve the technical disadvantages of higher power consumption and flicker of picture etc. in the prior art, on the premise of maintaining the brightness of the liquid crystal panel.

In order to realize the above object, the invention provides a processing device of high dynamic contrast for liquid crystal display apparatus, comprising:

A receiver, receiving a low voltage Differential Signaling data, and performing a format conversion on said data;

A central processing module, performing a histogram statistical process on the data subjected to the format conversion, obtaining a backlight source dimming coefficient and Gamma reference voltage parameter of the same frame of picture according to the result of the statistical process, generating a pulse wide modulation dimming control signal and a Gamma reference voltage;

An inverter, receiving the pulse wide modulation dimming control signal from said central processing module, and driving the backlight source; and A source driving IC, receiving the Gamma reference voltage from said central processing module, and driving a liquid crystal panel.

Wherein, said central processing module comprises:

A statistical module, receiving the data subjected to the format conversion from said receiver, performing the histogram statistical process on said data;

A query module, receiving the result of said histogram statistical process from said statistical module, obtaining the backlight source dimming coefficient and Gamma reference voltage parameter of the same frame of picture according to the result of the statistical process;

A signal controller, receiving said dimming coefficient from said query module, generating the pulse wide modulation dimming control signal to be sent to said inverter;

A bus controller, receiving said Gamma reference voltage parameter from said query module, converting it into a bus format; and A Gamma voltage controller, receiving the Gamma reference voltage parameter subjected to the format conversion from the bus controller, generating the Gamma reference voltage to be sent to the source driving IC.

Wherein, said query module comprises a storage unit which stores a lookup table therein, said lookup table recording the correspondence between the backlight source dimming coefficient and Gamma reference voltage parameter.

Based on the above solution, the processing device further comprises:

A frame buffer, for receiving and storing the data subjected to the format conversion; and A transmitter, for reading data from said frame buffer, and transmitting it to said source driving IC.

In order to realize the above object, the invention further provides a processing method of high dynamic contrast for liquid crystal display apparatus, comprising:

Performing a histogram statistical process on received low voltage Differential Signaling data;

Obtaining a backlight source dimming coefficient and a Gamma reference voltage parameter of the same frame of picture according to the result of the histogram statistical process;

Controlling the brightness of the backlight source according to said backlight source dimming coefficient; and Controlling the voltage of the pixel capacitor on the liquid crystal panel according to said Gamma reference voltage parameter.

Wherein, particularly, said performing a histogram statistical process on received low voltage Differential Signaling data is that:

Step 11 of converting the received low voltage Differential Signaling data into gray scales;

Step 12 of obtaining the number of pixel points occupied on a frame of picture by each gray scale;

Step 13 of comparing the number of pixel points of each gray scale with a high threshold value, and if it is more than the high threshold value, setting the result stored in a register for storing the result of gray scale statistics to 1, performing step 16; otherwise, performing step 14;

Step 14 of comparing the number of pixel points of the gray scale with a low threshold value, and if it is less than the low threshold value, setting the result stored in a register for storing the result of gray scale statistics to 0, performing step 16; otherwise, performing step 15;

Step 15, that a register for storing the result of gray scale statistics for the picture of the present frame reading and storing the result of gray scale statistics stored in a backup register for backuping the result of gray scale statistics for the picture of the previous frame;

Step 16 of inputting the result stored in the gray scale register for the picture of the present frame to a query module;

Step 17 of saving a copy of the result stored in the gray scale register for the picture of the present frame to the backup register of said grayscale for the picture of the present frame.

Wherein, particularly, said obtaining a backlight source dimming coefficient and a Gamma reference voltage parameter of the same frame of picture according to the result of the histogram statistical process is that:

Step 21 of determining a target dimming coefficient for the picture of the present frame according to statistical result of a statistical module, on the premise that the details of the medium and lower gray scales with more distribution are guaranteed to be not lost;

Step 22 of judging whether the target dimming coefficient obtained by the statistical module for the picture of the present frame is equal to the final dimming coefficient output from a query module for the picture of previous frame, if so, resetting the step value of the dimming coefficient to 0, setting the target dimming coefficient for the picture of the present frame as the final dimming coefficient, performing step 26; otherwise, performing step 23;

Step 23 of judging whether the target dimming coefficient for the picture of the present frame is equal to the target dimming coefficient for the picture of previous frame, if so, adjusting the dimming coefficient according to the step value which is same as that for the picture of the previous frame to obtain the final dimming coefficient for the picture of the present frame, performing step 26; otherwise, performing step 24;

Step 24 of redetermining the step value of the dimming coefficient;

Step 25 of obtaining the final dimming coefficient for the picture of the present frame according to the redetermined step value;

Step 26 of determining the Gamma reference voltage parameter according to the final dimming coefficient for the picture of the present frame;

Wherein, particularly, said controlling the brightness of the backlight source according to said backlight source dimming coefficient is that:

Generating the pulse wide modulation dimming control signal according to said backlight source dimming coefficient;

Driving the backlight source by using the pulse wide modulation dimming control signal.

Wherein, particularly, said controlling the voltage of the pixel capacitor on the liquid crystal panel according to said Gamma reference voltage parameter is that:

Converting the Gamma reference voltage parameter into a bus format;

Generating the Gamma reference voltage according to the Gamma reference voltage parameter in the bus format;

Transmitting the Gamma reference voltage to the source driving IC, generating the voltage of the pixel capacitor by the source driving IC.

The processing device and processing method of high dynamic contrast for liquid crystal display apparatus which is controlled by the backlight source proposed by this invention decrease the picture by decreasing the brightness of the backlight source, while changing the transmissivity of the liquid crystal panel by adjusting the voltage of the pixel capacitor on the liquid crystal panel, and compensating for the distortion due to the decreasing of the brightness of the backlight source by the transmissivity. Since this invention adjusts the brightness of the backlight source and the transmissivity of the pixel points of the liquid crystal panel simultaneously according to the result of the histogram statistical process, the dynamic contrast of the picture is increased, the problem of lower contrast of TFT liquid crystal display apparatus is ameliorated. The technical solution maintains the brightness of the liquid crystal panel constant after the brightness of the backlight source is changed in a manner of brightness query, thus the problem of flicker is ameliorated. At the same time, since the brightness of the backlight source is adjusted in a manner of dimming by external pulse wide modulation, the power consumption of the backlight source is saved prominently, and especially when the played picture is dominated by darkness, the effect of power save is very prominent. The power consumption of the backlight source is more than 40% of that of the liquid crystal display apparatus. The backlight source brightness adjusting solution in the invention saves the power consumption of the backlight source, decreases the power consumption of the final product. Further, the invention improves the main parameters of the product, thus improving the value of the TFT liquid crystal display apparatus greatly.

The technical solution of this invention will be described in detail through the drawings and embodiments.

DESCRIPTION OF THE REFERENCE NUMERALS

10: receiver; 20: statistical module; 30: query module; 40: signal controller; 50: inverter; 60: bus controller; 70: Gamma voltage controller; 80: source driving IC; 90: frame buffer; 100: transmitter.

DETAILED DESCRIPTION OF THE PREFERRED EMBODIMENT

Figure 1:
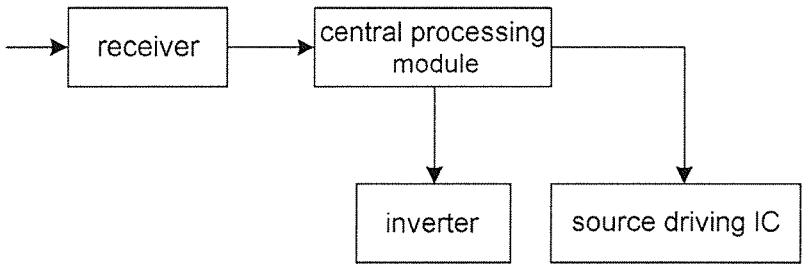
FIG. 1 is a structural schematic diagram of the processing device of high dynamic contrast for liquid crystal display apparatus of the invention.

FIG. 1 is a structural schematic diagram of the processing device of high dynamic contrast for liquid crystal display apparatus of the invention. The processing device of high dynamic contrast for liquid crystal display apparatus includes a receiver, an inverter, and a source driving IC connected with a central processing module respectively; the receiver is for receiving low voltage Differential Signaling data, and performing a format conversion on said data; the central processing module is for performing a histogram statistical process on the received data subjected to the format conversion, obtaining a backlight source dimming coefficient and a Gamma reference voltage parameter of the same frame of picture according to the result of the statistical process, generating a pulse wide modulation dimming control signal and a Gamma reference voltage; the inverter and the source driving IC are used as execution mechanisms; the inverter is for receiving the pulse wide modulation dimming control signal from said central processing module and driving the backlight source, controlling the brightness of the backlight source; the source driving IC is for receiving the Gamma reference voltage from said central processing module and driving a liquid crystal panel, controlling the voltage applied to the pixel capacitors on liquid crystal panel, and maintaining the brightness of the liquid crystal panel constant after the brightness of the backlight source is changed, by changing the transmissivity of the pixel points on the liquid crystal panel.

The above technical solution of the invention decreases the brightness of picture by decreasing the brightness of the backlight source, while changing the transmissivity of the liquid crystal panel by adjusting the driving voltage of the pixel points on the liquid crystal panel, and compensating for the distortion due to the decreasing of the brightness of the backlight source by the transmissivity. Particularly, the invention performs a histogram statistical process on the input low voltage Differential Signaling data, adjusts the brightness of the backlight source and the transmissivity of the pixel points of the liquid crystal panel simultaneously according to the result of the process, and thus the dynamic contrast of picture is increased, the problem of lower contrast of TFT liquid crystal display apparatus is ameliorated. The technical solution maintains the brightness of the liquid crystal panel constant after the brightness of the backlight source is changed, thus the problem of flicker is ameliorated. At the same time, since the brightness of the backlight source is adjusted in a manner of dimming by the external pulse wide modulation, the power consumption of the backlight source is saved.

Figure 2:
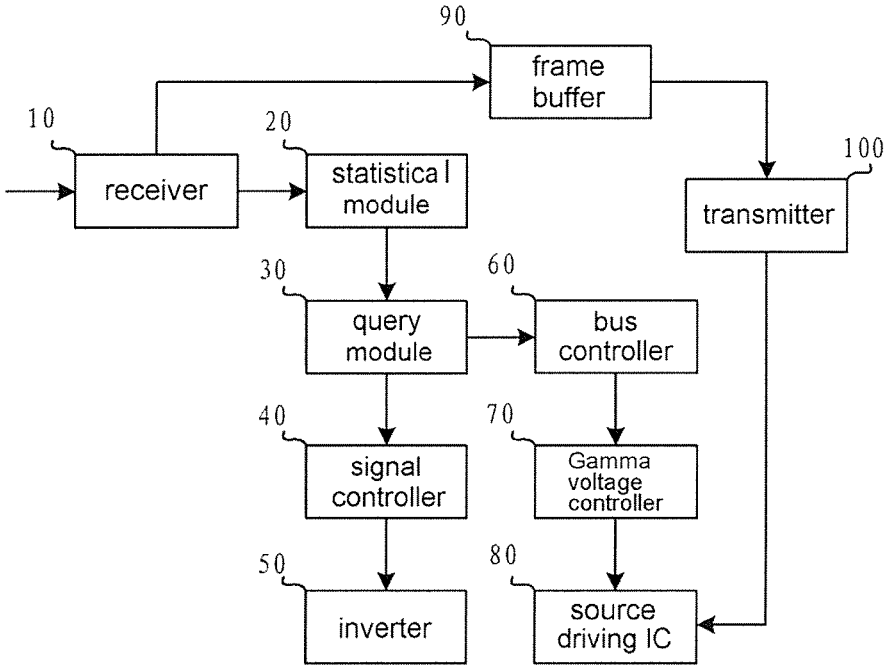
FIG. 2 is a structural schematic diagram of an embodiment of the invention.

FIG. 2 is a structural schematic diagram of an embodiment of the invention, this embodiment includes a receiver 10, a statistical module 20, a query module 30, a signal controller 40, and an inverter 50 connected in series sequentially, and further includes a bus controller 60, a Gamma voltage controller 70, and a source driving IC 80 connected in series sequentially, and the query module 30 is connected with the bus controller 60. Wherein, the receiver 10 receives the input LVDS data, and performs a format conversion on the LVDS data; the statistical module 20 receives the data subjected to the format conversion from said receiver 10, performs the histogram statistical process on said data; the query module 30 receives a result of said histogram statistical process from said statistical module 20, obtains a backlight source dimming coefficient for the same frame of picture according to the result of the statistical process, and obtains a Gamma reference voltage parameter according to the dimming coefficient; the signal controller 40 receives said backlight source dimming coefficient from the query module 30, generates a pulse wide modulation dimming control signal; the inverter 50 receives the pulse wide modulation dimming control signal from the signal controller 40, drives the backlight source according to the pulse wide modulation dimming control signal, changes the brightness of the backlight source; at the same time, the bus controller 60 receives the Gamma reference voltage parameter from the query module 30, converts said Gamma reference voltage parameter into a bus format; the Gamma voltage controller 70 receives Gamma reference voltage parameter in the bus format from the bus controller 60, generates a Gamma reference voltage; the source driving IC 80 receives the Gamma reference voltage form the Gamma voltage controller 70, drives the liquid panel according to the Gamma reference voltage, controls the voltage applied to the pixel capacitor of each pixel on liquid crystal panel, changes the transmissivity of each pixel point on the liquid crystal panel, and thereby the brightness of the pixel points whose gray scale distributions are dominant on the liquid crystal panel maintains constant after the brightness of the backlight source is changed.

The receiver 10 receives the input low voltage Differential Signaling data, and converts it into the data of TTL format, and thus facilitates the data statistics performed by the statistical module.

The histogram statistics is to count the brightness of each point on a frame of picture together in a manner of grey scale, obtain the distribution of each gray scale according to the count result. For example, the resolution of a display is XGA (1024×768), that is, there are 1024×768=786432 pixel points in a whole frame of picture, wherein each pixel point consists of three sub pixels of red (R), green (G), and blue (B). The histogram statistical module 20 synthesizes the R, G, B data of TTL format input from the receiver 10 into the gray scales corresponding to the pixel points according to the gray scale synthesis formula (1) as follows:

$$Y=0.299R+0.587G+0.114B \quad (1)$$

Thus, the statistics can be performed on all the pixel points by using gray scale as a criteria, and the result of the statistics is the number of pixel points occupied on the frame of picture by each gray scale. The statistical module 20 of this embodiment performs the histogram statistics on the input data, the details thereof are that: for each gray scale of the picture of the nth frame (n=1, 2, . . . ), two registers $R_n$, $R_n'$ store the result of the histogram statistics, $R_n'$ is a backup register, that is, when histogram statistics on the frame of picture is completed, the final result of statistics stored in $R_n$ is transmitted to the query module, while a copy of the result of statistics is stored in $R_n'$. For the above results of statistics, two threshold values are established, one is a high threshold value, the other is a low threshold value. If the result of statistics of a gray scale is higher than the high threshold value, the process on the gray scale should at least guarantee the original details thereof; if the result of statistics of a gray scale is lower than the low threshold value, the details of the gray scale can be compressed appropriately; if the result of statistics of a gray scale is between the high threshold value and the low threshold value, it shows that the number of the gray scales does not satisfy the degree for enforcing the detail process thereof, nor does it satisfy the degree for compressing the detail of the gray scale. At this time, the result of statistics stored in $R_{n-1}'$ of the picture of the previous frame is transmitted to $R_n$ of the picture of the present frame, the processing on the gray scale is determined according to the result of statistics on the picture of the previous frame stored in $R_n$.

In this embodiment, a two-threshold value judging method is employed to count the histogram result, which avoids the case caused by using a single-threshold value judging method that the backlight source dimming coefficient is varied continuously due to the statistics values of a group of pictures jumping away from the threshold values back and forth within several continuous frames of pictures, thus the flicker felt by human eyes can be ameliorated.

The query module 30 of this embodiment determines the dimming coefficient β of the backlight source based on the result of statistics of the statistical modular 20. For example, if the number of high gray scales in the result of statistics is less, that is, the whole frame of picture is a relative dark picture, the dimming coefficient β can be decreased, and the standard of decreasing is to guarantee that at least the details of more distributed medium and low gray scales are not lost.

Figure 3:
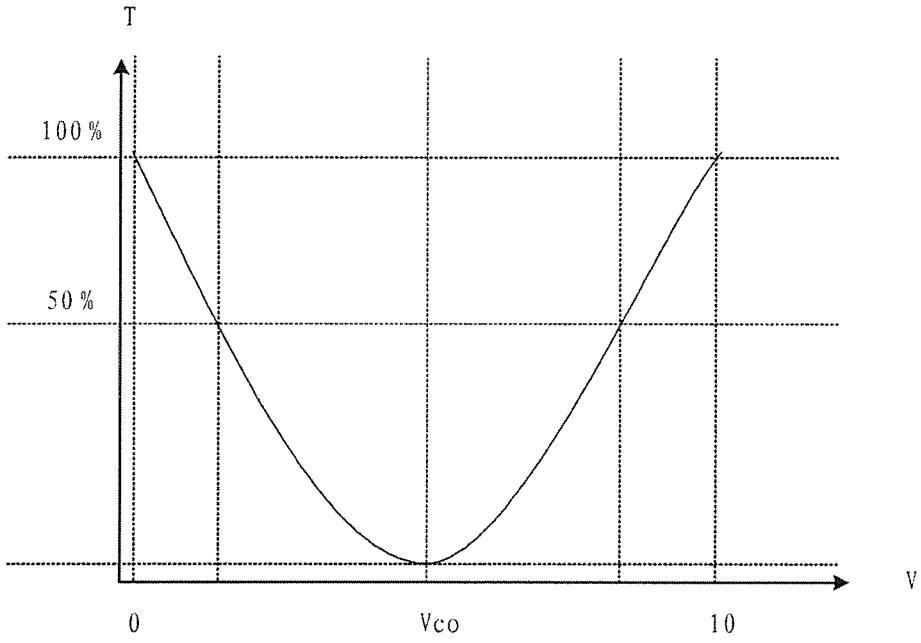
FIG. 3 is a V-T graph of the transmissivity of a pixel point on the liquid crystal panel vs. the voltage of the pixel capacitor on the pixel point.

FIG. 3 is a V-T graph of the transmissivity of a pixel point on the liquid crystal panel vs. the voltage of the pixel capacitor on the pixel point, which reflects the relation between the transmissivity of a pixel point on the TFT liquid crystal panel and the voltage applied to the pixel capacitor on the pixel point, and also directly reflects the basic display character of the TFT liquid crystal panel. For the TFT liquid crystal panel in constant-black mode, when the brightness of the backlight source is constant, the V-T curve thereof is as shown in FIG. 3. Wherein, the abscissa represents the voltage V of the pixel capacitor, and the ordinate represents the transmissivity T of a pixel point on the liquid crystal panel.

Figure 4:
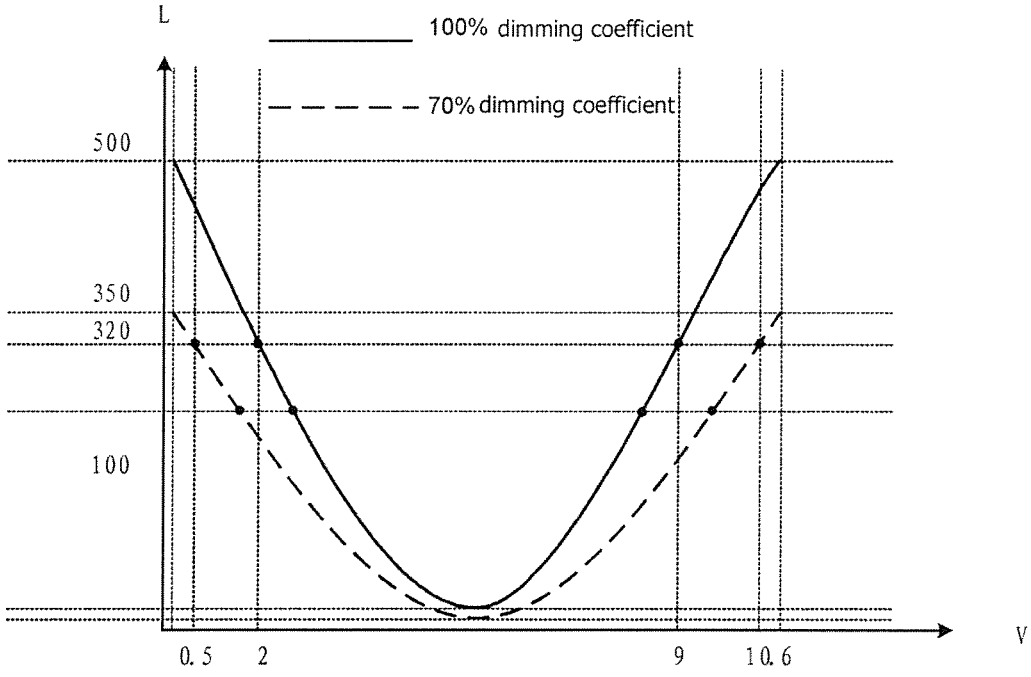
FIG. 4 is an L-V graph of the brightness of a pixel point on the liquid crystal panel vs. the voltage of the pixel capacitor on the pixel point.

FIG. 4 is an L-V graph of the brightness of a pixel point on the liquid crystal panel vs. the voltage of the pixel capacitor on the pixel point. The brightness displayed on the liquid crystal panel can be represented as:

$$L=B(\beta)\times T(V) \tag{2}$$

wherein, L represents the brightness of a pixel point on the liquid crystal panel; B represents the brightness of the backlight source which is a function of the dimming coefficient β; T represents the transmissivity of a pixel point on the liquid crystal panel which is a function of the voltage V of the pixel capacitor.

According to the above formula, the relation between the brightness L of the liquid crystal panel and the voltage V of the pixel capacitor, which is called as L-V curve, can be obtained. The brightness of the backlight source B is proportional to the dimming coefficient β. When the dimming coefficient β=100%, the brightness of the backlight source is largest; as the dimming coefficient β is decreased, the brightness of the backlight source is decreased. Thus, according to different dimming coefficients β, different L-V curves can be plotted based on the above formula (as shown in FIG. 4). When the dimming coefficient β=100%, the largest brightness of the liquid crystal panel is 500 nit; when β=70%, the largest brightness of the liquid crystal panel is 350 nit. For the points with the brightness of 320 nit of the liquid crystal panel, the corresponding points can be found on both curves of β=100% and β=70%, and only the corresponding voltages V of the pixel capacitor are different. For the different dimming coefficients $\beta_1$ and $\beta_2$, if the brightness of the pixel point on the liquid crystal panel is required to be the same, the relation of the corresponding voltage of the pixel capacitor can be obtained by using the above formula, that is:

$$B(\beta_1)\times T(V_1)=B(\beta_2)\times T(V_2) \tag{3}$$

wherein, $V_1$ is the corresponding voltage of the pixel capacitor under the dimming coefficient $\beta_1$, $T(V_1)$ is the transmissivity of the pixel point on the liquid crystal panel corresponding to the voltage $V_1$ of the pixel capacitor; $V_2$ is the voltage of the pixel capacitor under the dimming coefficient $\beta_2$, $T(V_2)$ is the transmissivity of the pixel point on the liquid crystal panel corresponding to the voltage $V_2$ of the pixel capacitor. Thus, the dimming coefficient β can be decreased to some extent, the transmissivity of the pixel point on the liquid crystal panel can be changed by adjusting the voltage V of the pixel capacitor, and thus the final brightness output from the pixel point on the liquid crystal panel is maintained constant.

Particularly, the procedure of establishing the correspondence between the brightness of the backlight source and the Gamma reference voltage parameter is that: adjusting the formula to:

$$B(\beta_1)\times T(V'_1)=B(\beta_2)\times T(V'_2) \tag{4}$$

wherein $V'_1$ is the Gamma voltage under the dimming coefficient $\beta_1$, $V'_2$ is the Gamma voltage under the dimming coefficient $\beta_2$. The Gamma voltage V' is the reference point of the voltage V of the pixel capacitor, the voltage of the pixel capacitor is generated by dividing the Gamma voltage with the internal resistors of the source driving IC. Assuming the dimming coefficient $\beta_1$ is equal to the maximum of the backlight dimming coefficient (duty ratio is 100%) all the time, and $V'_1$ is equal to the Gamma voltage in the state of the dimming coefficient $\beta_1$. When the histogram statistics on the frame of picture is completed, the dimming coefficient $\beta_2$ can be obtained according to the result of the histogram statistics, and whenever a $V'_1$ is given, the corresponding Gamma voltage $V'_2$ in the state of the dimming coefficient $\beta_2$ can be calculated according to the formula (4). According to such a procedure, the Gamma voltages corresponding to all dimming coefficients are calculated and stored in the lookup table. During the system is operating, when it is detected that a certain dimming coefficient is outputted, the Gamma reference voltage corresponding to the dimming coefficient is also read from the lookup table, and thus the lookup procedure is completed.

From the above analysis, it can be seen that actually the query module 30 of this embodiment is a table structure, said table structure reflects the correspondence between the backlight source dimming coefficient and the Gamma reference voltage. Particularly, the main structure of the query module 30 is a storage unit storing a lookup table, which is in cooperation with the corresponding addressing device. After performing the histogram statistical process on the input data by the statistical module 20, the statistical result of gray scales distribution of the frame of picture would be obtained. The query module 30 obtains the backlight source dimming coefficient according to the result of the histogram statistics processing, and the Gamma reference voltage parameter corresponding to the dimming coefficient can be found by looking up the lookup table the stored relation table of the backlight source dimming coefficient and the Gamma reference voltage parameter, wherein the Gamma reference voltage parameter is the Gamma reference voltage in numeral format.

For several continuous frames of pictures with great difference in brightness and darkness, if the dimming coefficient is determined according to the statistical result of the statistical module based on the above method, the brightness transition trends to be unnatural, thus this embodiment determines the dimming coefficient for the pictures of several continuous frames in a stepping manner. The dimming coefficient β of the picture of the first frame is determined based on the statistical result of the statistical module according to the above method, and the dimming coefficients of subsequent frames are adjusted in the stepping manner. The detailed method of adjusting the dimming coefficient in the stepping manner is as follows: for the picture of a frame, the dimming coefficient obtained based on the statistical result of the statistical module is called as a target dimming coefficient, and the dimming coefficient output from the query module subjected to the adjustment in the stepping manner is called a final dimming coefficient. Two groups of registers are used to store the target dimming coefficient and the final dimming coefficient for the picture of each frame. After the statistics on the picture of the present frame is completed, the dimming coefficient obtained from the statistics on the picture of the present frame is compared with the final dimming coefficient for the picture of the previous frame. Assuming the dimming coefficient output from the query module for the previous frame is a %, if the target dimming coefficient obtained by the statistical module for the picture of the present frame is also a %, the step value is reset to 0. If the target dimming coefficient obtained by the statistical module for the picture of the present frame is different from the final dimming coefficient for the picture of the previous frame, then the target dimming coefficient for the picture of the present frame is compared with the target dimming coefficient for the picture of the previous frame. If the two target dimming coefficients are equal, the dimming coefficient for the picture of the present frame is adjusted according to the step value same with that of the picture of the previous frame. Assuming the step value of the picture of the previous frame is b %, then the final dimming coefficient for the picture of the present frame subjected to the step adjustment is (a+b) %. If the target dimming coefficient for the picture of the present frame is not equal to that for the picture of the previous frame, it shows that the brightness and darkness state of the picture is changed greatly. At this time, the step value should be redetermined based on the final dimming coefficient for the picture of the previous frame and the target dimming coefficient obtained for the picture of the present frame. Assuming the redetermined step value is c %, then the final dimming coefficient for the picture of the present frame subjected to the step adjustment is (a+c) %; and then the final dimming coefficient for the picture of the present frame subjected to the step adjustment is output to the signal controller 40.

The method for determining the step value of the dimming coefficient is as follows: assuming the final dimming coefficient for the picture of the present frame subjected to the step adjustment is a % and the target dimming coefficient obtained by the statistical module for the picture of the present frame is y %, and the following steps are required to be performed to make the final dimming coefficient subjected to the step adjustment equal to the target dimming coefficient within m continuous frames of pictures: dividing the difference between the final dimming coefficient for the picture of the previous frame and the target dimming coefficient for the picture of the present frame by m, obtaining a new step value which should be (y %−a %)/m, and then adding the new step value to the final dimming coefficient for the picture of the previous frame to obtain the dimming coefficient for the picture of the present frame, that is, the dimming coefficient for the picture of the present frame is a %+(y %−a %)/m. The method of determining the step value for the picture of the next frame is same as that of the picture of the present frame, wherein the value of m is determined according to the requirement of the actually processed picture.

The dimming coefficient is adjusted according to the stepping manner as above, and then the Gamma reference voltage parameter to be output is determined according to the relation between the dimming coefficient and the Gamma reference voltage parameter stored in the query module, which is equivalent to adjust the Gamma reference voltage in a stepping manner also. Thus the dimming coefficient and the voltage of the pixel capacitor are adjusted simultaneously, and the variable range of the dimming coefficient and the voltage of the pixel capacitor are defined. For the case that two continuous frames of pictures have great difference in the brightness and darkness, such stepping manner of adjustment can make the transition of the brightness between the pictures smooth and natural.

The query module 30 inputs the dimming coefficient to the signal controller 40, in the above embodiment of this invention, the signal controller 40 is actually a Pulse Width Modulation (PWM) Dimming signal controller, which controls the brightness of the backlight source by adjusting the duty ratio of outputting the PWM Dimming control signal, wherein the duty ratio of the PWM Dimming signal is the dimming coefficient β of the backlight source. The brightness of the backlight source of Cold Cathode Fluorescent Light (CCFL) is determined directly by the lamp current of CCFL lamp, the driving of the lamp current is realized by a DC to AC inverter. A digital manner of adjusting the brightness of the inverter is also called as pulse width modulation manner (called PWM manner for short), the brightness of the backlight source is controlled by adjusting the duty ratio of the PWM Dimming signal. The larger the duty ratio of the PWM Dimming signal, the longer the duration in which the backlight source is ON in a dimming period, and thus the brightness of the backlight source is higher. Since the backlight source is always in the state of continuous switching ON and OFF in this manner of adjustment, the switching ON and OFF of the backlight source is controlled by the PWM Dimming signal with frequency (generally between 120 Hz~240 Hz) higher than the refreshing frequency, thus human eyes would not feel the flicker of the backlight source.

In the embodiments of the invention, the signal controller 40 inputs the PWM Dimming signal to the inverter 50, and controls the brightness of the backlight source by adjusting the duty ratio of the PWM Dimming signal.

In the technical solution of this invention, the Gamma reference voltage is the reference point of the voltage of the pixel capacitor, the voltage of the pixel capacitor is generated by dividing the Gamma voltage with the internal resistors of the source driving IC. The bus controller 60 is an $I^2C$ bus or serial peripheral interface (called as SPI for short) bus controller, which performs a format conversion on the Gamma reference voltage parameter output from the query module 30. The Gamma voltage controller is a programmable Gamma voltage controller, which converts the Gamma reference voltage parameter into corresponding Gamma reference voltage. Based on the above technical solution, this invention further includes a frame buffer 90 and a transmitter 100 connected in series between the receiver 10 and the source driving IC 80, wherein the frame buffer 90 may consist of SDRAM or DDR SDRAM. The frame buffer 90 received data from the receiver 10 and stored, and the transmitter 100 reads the data from the frame buffer 90, and then sends it to the source driving IC 80. Since this invention needs to perform operations, such as histogram statistics and query, etc. on input LVDS data, the frame buffer 90 functions for storing data temporarily. After the operations of this invention are completed, the liquid crystal panel performs the display process.

The operation procedure of the processing device of high dynamic contrast for liquid crystal display apparatus is that: firstly, the receiver 10 receives the input LVDS data and performs a format conversion on it, while outputting it to the frame buffer 90 for storage. The receiver 10 converts the format of series bus of LVDS data into the format of parallel bus, and then the statistical module 20 performs the histogram statistical process. The query module 30 looks up the table structure according to the statistical result, and then obtains the corresponding backlight source dimming coefficient and the Gamma reference voltage parameter, transmits the backlight source brightness control parameters to the signal controller 40, transmit the Gamma reference voltage of the same frame of picture to the bus controller 60. The signal controller 40 generates the pulse wide modulation dimming control signal, and transmits the signal to the inverter 50 which drives the backlight source. The bus controller 60 converts the Gamma reference voltage parameter into the bus format, and transmits it to the programmable Gamma voltage controller 70. The Gamma voltage controller 70 generates the corresponding Gamma reference voltage and transmits it to the source driving IC 80. At the same time, the transmitter 100 reads out the data stored in the frame buffer 90, and transmits it to the source driving IC 80. Thus the synchronized adjustment on the brightness of the backlight source and the Gamma reference voltage is completed.

As can be seen from above, since the backlight source is continuously controlled by the PWM Dimming signal output from the signal controller 40, and in the state of continuous switching ON and OFF, the power consumption is saved in some extend. Especially when the played picture is dominated by darkness, the saved power consumption is more. The power consumption of the backlight source is more than 40% of that of the liquid crystal display apparatus. The backlight source brightness adjusting solution in this invention saves the power consumption of the backlight source, and decreases the power consumption of the final product.

Figure 5:
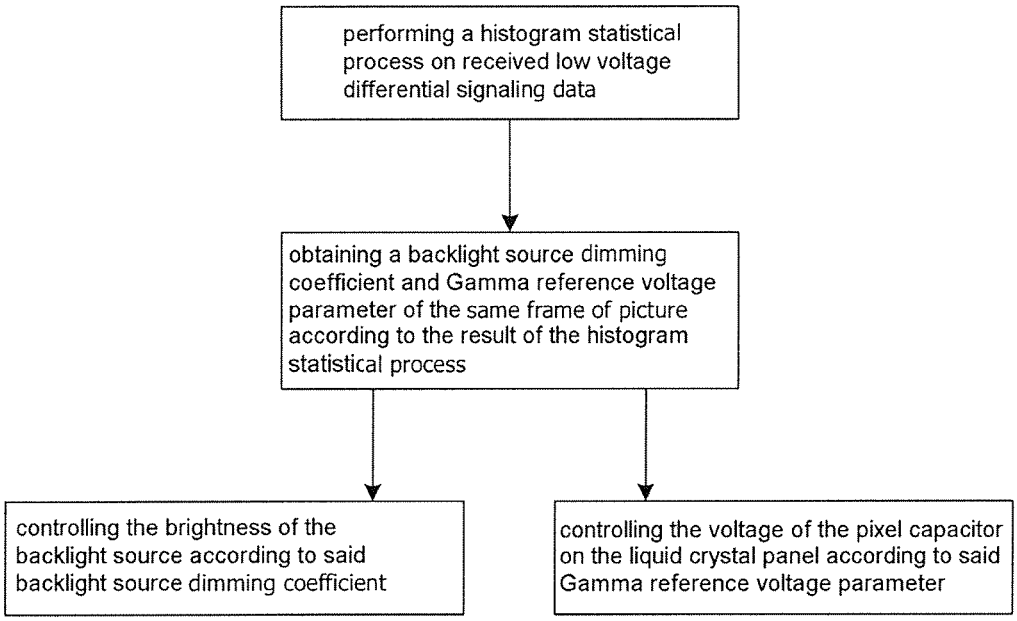
FIG. 5 is a flowchart of the processing method of high dynamic contrast for liquid crystal display apparatus of the invention.

FIG. 5 is a flowchart of the processing method of high dynamic contrast for liquid crystal display apparatus of the present invention, with the details that:

Step 10 of performing a histogram statistical process on received low voltage Differential Signaling data;

Step 20 of obtaining a backlight source dimming coefficient and a Gamma reference voltage parameter of the same frame of picture according to the result of the histogram statistical process;

Step 30 of controlling the brightness of the backlight source according to said backlight source dimming coefficient;

Step 40 of controlling the voltage of the pixel capacitor on the liquid crystal panel according to said Gamma reference voltage parameter.

The above technical solution of the invention decreases the brightness of picture by decreasing the brightness of the backlight source, while changing the transmissivity of the liquid crystal panel by adjusting the voltage of the pixel capacitor on the liquid crystal panel, and compensating for the distortion due to the decreasing of the brightness of the backlight source by the transmissivity. Particularly, this invention performs a histogram statistical process on the input data, adjusts the brightness of the backlight source and the transmissivity of the pixel point of the liquid crystal panel simultaneously according to the result of the process, and hence the dynamic contrast of picture is improved and the problem of lower contrast of TFT liquid crystal display apparatus is ameliorated. The technical solution maintains the brightness of the pixel points dominant on the liquid crystal panel constant after the brightness of the backlight source is changed, thus the problem of flicker is ameliorated. At the same time, since the brightness of the backlight source is adjusted in a manner of external pulse wide modulation dimming, the power consumption of the backlight source is saved.

Figure 6:
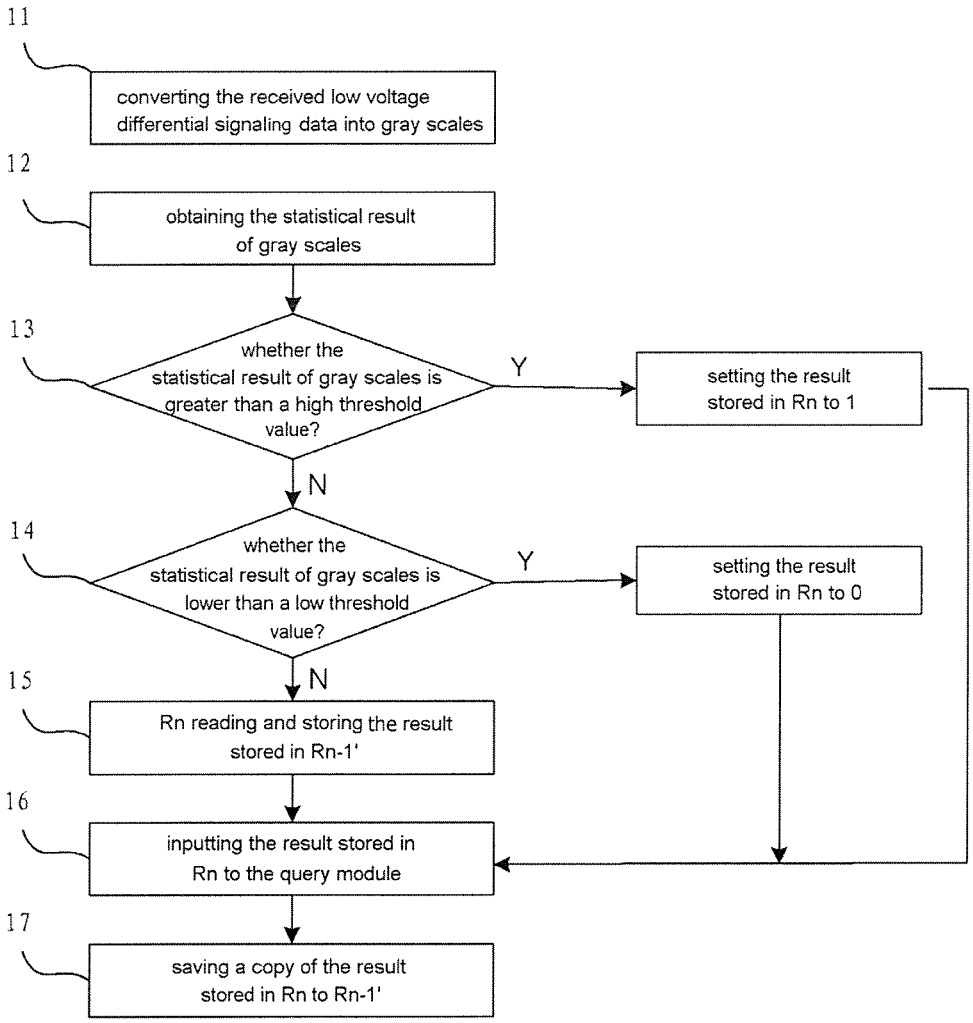
FIG. 6 is a flowchart of performing histogram statistical process on received low voltage Differential Signaling data of the invention.

FIG. 6 is a flowchart of performing a histogram statistical process on received low voltage Differential Signaling data of this invention, with the details that:

Step 11 of converting the received low voltage Differential Signaling data into gray scales;

Step 12 of obtaining the number of pixel points occupied on the frame of picture by each gray scale;

Step 13 of comparing the number of pixel points of each gray scale with a high threshold value, if it is more than the high threshold value, setting the result stored in a register $R_n$ for storing the result of gray scale statistics to 1, performing step 16; otherwise, performing step 14;

Step 14 of comparing the number of pixel points of said gray scale with a low threshold value, if it is less than the low threshold value, setting the result stored in the register $R_n$ for storing the result of gray scale statistics to 0, performing step 16; otherwise, performing step 15;

Step 15, that the register $R_n$ for storing the result of gray scale statistics for the picture of the present frame reading and storing the result of gray scale statistics stored in a backup register $R_{n-1}'$ for backuping the result of gray scale statistics for the previous frame picture;

Step 16 of inputting the result stored in the gray scale register for the picture of the present frame to a query module;

Step 17 of saving a copy of the result stored in the gray scale register $R_n$ for the picture of the present frame to the backup register $R_n'$ of said gray scale for the picture of the present frame.

This invention firstly performs statistics on all of the pixel points based on a gray scale criterion by using the histogram statistics, obtains the number of pixel points occupied on the frame of picture by each gray scale, obtains the distribution condition of each gray scale in the frame of picture by comparing the number with the two threshold values.

Figure 7:
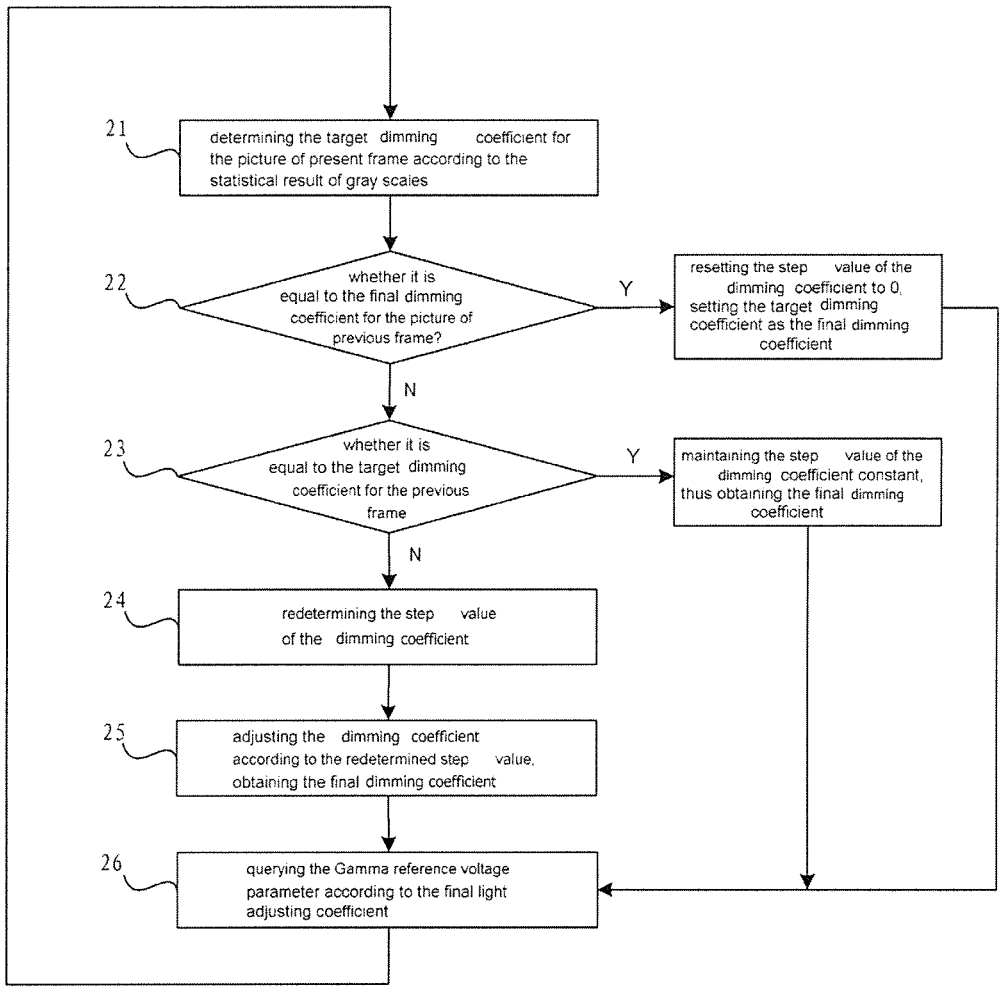
FIG. 7 is a flowchart of obtaining a backlight source dimming coefficient and a Gamma reference voltage parameter of the same frame of picture according to the result of the histogram statistical process.

FIG. 7 is a flowchart of obtaining a backlight source dimming coefficient and a Gamma reference voltage parameter of the same frame of picture according to the result of the histogram statistical process with the details that:

Step 21 of determining the target dimming coefficient for the picture of the present frame according to the statistical result of the statistical module, on the premise that the details of the medium and lower gray scales with more distribution are guaranteed to be not lost;

Step 22 of judging whether the target dimming coefficient of the picture of the present frame is equal to the final dimming coefficient for the picture of previous frame, if so, resetting the step value of the dimming coefficient to 0, setting the target dimming coefficient for the picture of the present frame as the final dimming coefficient, performing step 26; otherwise, performing step 23;

Step 23 of judging whether the target dimming coefficient for the picture of the present frame is equal to the target dimming coefficient for the picture of the previous frame, if so, adjusting the dimming coefficient for the picture of the present frame using the step value of the picture of previous frame, setting the dimming coefficient subjected the step adjustment as the final dimming coefficient, performing step 26; otherwise, performing step 24;

Step 24 of recalculating and determining the step value of the dimming coefficient;

Step 25 of obtaining the final dimming coefficient for the picture of the present frame according to the redetermined step value;

Step 26 of determining the Gamma reference voltage parameter by looking up the relation between the dimming coefficient and the Gamma reference voltage parameter stored in the query module, according to the final dimming coefficient for the picture of the present frame.

Once the dimming coefficient is determined, the Gamma reference voltage parameter corresponding to the dimming coefficient can be obtained by looking up in the lookup table the stored relation of the dimming coefficient and the Gamma reference voltage parameter. The backlight source dimming coefficient herein is the duty ratio of the PWM Dimming signal.

Wherein, particularly, the step 30 is that:

Step 31 of generating the pulse wide modulation dimming control signal according to said backlight source dimming coefficient;

Step 32 of driving the backlight source by using the pulse wide modulation dimming control signal.

Driving the backlight source dimming coefficient after generating the pulse wide modulation dimming control signal from the backlight source dimming coefficient, and then the brightness of the backlight source is changed.

Wherein, particularly, the step 40 is that:

Step 41 of converting the Gamma reference voltage parameter into a bus format;

Step 42 of generating the Gamma reference voltage according to the Gamma reference voltage parameter in the bus format;

Step 43 of transmitting the Gamma reference voltage to the source driving IC, generating the voltage of the pixel capacitor by the source driving IC, and driving the liquid crystal panel.

Driving the liquid crystal panel after generating the Gamma reference voltage from the Gamma reference voltage parameter subjected to the format conversion, and changing the transmissivity of the liquid crystal panel, thus the brightness of the pixel points whose gray scale distributions are dominant on the liquid crystal panel maintains constant after the brightness of the backlight source is changed.

The above technical solutions of this invention greatly increases the dynamic contrast of the picture and the quality of the picture on the premise that the brightness of the liquid crystal panel is constant, decreases the brightness of picture by decreasing the brightness of the backlight source, while changing the transmissivity of the liquid crystal panel by adjusting the voltage of the pixel points on the liquid crystal panel, and compensating for the distortion due to the decreasing of the brightness of the backlight source by the transmissivity. Particularly, the processing method of high dynamic contrast for liquid crystal display apparatus of the present invention performs a histogram statistical process on the received data, adjusts the brightness of the backlight source and the voltage of the pixel capacitor of the liquid crystal panel simultaneously according to the result of the statistical process, and hence increasing the dynamic contrast of the picture, and ameliorating the problem of lower contrast of TFT liquid crystal display apparatus. The technical solution of the processing method of high dynamic contrast for liquid crystal display apparatus maintains the brightness of the liquid crystal panel constant after the brightness of the backlight source is changed, thus the problem of flicker is ameliorated. At the same time, since the brightness of the backlight source is adjusted in a manner of external pulse wide modulation dimming, the power consumption of the backlight source is saved.

Finally, it should be noted that the above embodiments is only for explaining the technical solution of this invention, but not for limitation. Although this invention has been described in detail with reference to the preferred embodiments, it should be understood by those skilled in the art that the technical solution of this invention can be modified, or replaced equally, without departing from the spirit and scope of the technical solutions of this invention.

The invention claimed is:

1. A processing device of high dynamic contrast for liquid crystal display apparatus, characterized in comprising:

a receiver, receiving a low voltage Differential Signaling data, and performing a format conversion on said data;

a central processing module, performing a histogram statistical process on the data subjected to the format conversion, obtaining a backlight source dimming coefficient and a Gamma reference voltage parameter of the same frame of picture according to the result of the statistical process, generating a pulse wide modulation dimming control signal and a Gamma reference voltage;

an inverter, receiving the pulse wide modulation dimming control signal from said central processing module, and driving the backlight source; and a source driving IC, receiving the Gamma reference voltage from said central processing module, and driving a liquid crystal panel, whereby the luminance of the liquid crystal panel is kept unchanged after the luminance of the backlight source varies by changing the transmissivity of the pixel points on the liquid crystal panel and gray scales data of the pixel points distributed on the liquid crystal panel are the same as input data without losing any gray scale details, wherein the transmissivity of the pixel points on the liquid crystal panel is changed by adjusting the voltage of the pixel capacitor on the liquid crystal panel according to the Gamma reference voltage parameter;

wherein obtaining the backlight source dimming coefficient of the same frame of picture comprises:

judging whether a target dimming coefficient for the picture of a present frame is equal to a final dimming coefficient for the picture of a previous frame;

if so, setting the target dimming coefficient for the picture of the present frame as a final dimming coefficient for the picture of the present frame;

otherwise, judging whether the target dimming coefficient for the picture of the present frame is equal to the target dimming coefficient for the picture of the previous frame, if so, adjusting the dimming coefficient for the picture of the present frame by adding a step value same with that of the picture of the previous frame to the final dimming coefficient for the picture of the previous frame, and setting the adjusted backlight source dimming coefficient as the final dimming coefficient for the picture of the present frame;

otherwise, redetermining the step value of the backlight source dimming coefficient, and obtaining the final dimming coefficient for the picture of the present frame according to the redetermined step value.

2. The processing device of high dynamic contrast for liquid crystal display apparatus according to claim 1, characterized in that said central processing module comprises:

a statistical module, receiving the data subjected to the format conversion from said receiver, performing the histogram statistical process on said data;

a query module, receiving the result of said histogram statistical process from said statistical module, obtaining the backlight source dimming coefficient and Gamma reference voltage parameter of the same frame of picture according to the result of the statistical process;

a signal controller, receiving said dimming coefficient from said query module, generating the pulse wide modulation dimming control signal to be sent to said inverter;

a bus controller, receiving said Gamma reference voltage parameter from said query module, converting it into a bus format; and a Gamma voltage controller, receiving the Gamma reference voltage parameter subjected to the format conversion from the bus controller, generating the Gamma reference voltage to be sent to the source driving IC.

3. The processing device of high dynamic contrast for liquid crystal display apparatus according to claim 2, characterized in that said query module comprises a storage unit which stores a lookup table therein, said lookup table recording the correspondence between the backlight source dimming coefficient and the Gamma reference voltage parameter.

4. The processing device of high dynamic contrast for liquid crystal display apparatus according to claim 1, characterized in that it further comprises:

a frame buffer, for receiving and storing the data subjected to the format conversion; and a transmitter, for reading data from said frame buffer, and transmitting it to said source driving IC.

5. A processing method of high dynamic contrast for liquid crystal display apparatus, characterized in comprising:

performing a histogram statistical process on received low voltage Differential Signaling data;

obtaining a backlight source dimming coefficient and a Gamma reference voltage parameter of the same frame of picture according to the result of the histogram statistical process;

controlling the brightness of the backlight source according to said backlight source dimming coefficient;

controlling the voltage of a pixel capacitor on the liquid crystal panel according to said Gamma reference voltage parameter; and keeping the luminance of the liquid crystal panel unchanged after the luminance of the backlight source varies by changing the transmissivity of the pixel points on the liquid crystal panel and gray scales data of the pixel points distributed on the liquid crystal panel are the same as input data without losing any gray scale details, wherein the transmissivity of the pixel points on the liquid crystal panel is changed by adjusting the voltage of the pixel capacitor on the liquid crystal panel according to the Gamma reference voltage parameter;

wherein the obtaining the backlight source dimming coefficient of the same frame of picture comprises:

judging whether a target dimming coefficient for the picture of a present frame is equal to a final dimming coefficient for the picture of a previous frame;

if so, setting the target dimming coefficient for the picture of the present frame as a final dimming coefficient for the picture of the present frame;

otherwise, judging whether the target dimming coefficient for the picture of the present frame is equal to the target dimming coefficient for the picture of the previous frame, if so, adjusting the dimming coefficient for the picture of the present frame by adding a step value same with that of the picture of the previous frame to the final dimming coefficient for the picture of the previous frame, and setting the adjusted backlight source dimming coefficient as the final dimming coefficient for the picture of the present frame;

otherwise, redetermining the step value of the backlight source dimming coefficient, and obtaining the final dimming coefficient for the picture of the present frame according to the redetermined step value.

6. The processing method of high dynamic contrast for liquid crystal display apparatus according to claim 5, characterized in that said performing a histogram statistical process on received low voltage Differential Signaling data is that of:

converting the received low voltage Differential Signaling data into gray scales;

obtaining the number of pixel points occupied on the frame of picture by each gray scale;

comparing the number of pixel points of each gray scale with a high threshold value, and if it is more than the high threshold value, setting the result stored in a register for storing the result of gray scale statistics to 1, inputting the result; otherwise, comparing with a low threshold;

comparing the number of pixel points of the gray scale with a low threshold value, and if it is less than the low threshold value, setting the result stored in the register for storing the result of gray scale statistics to 0, inputting the result; otherwise, continue;

a register for storing the result of gray scale statistics for the picture of the present frame reading and storing the result of gray scale statistics stored in a backup register for backuping the result of gray scale statistics for the previous frame picture;

inputting the result stored in the gray scale register for the picture of the present frame to a query module;

saving a copy of the result stored in the gray scale register for the picture of the present frame to the backup register of said gray scale for the picture of the present frame.

7. The processing method of high dynamic contrast for liquid crystal display apparatus according to claim 5, characterized in that, said controlling the brightness of the backlight source according to said backlight source dimming coefficient is that:

generating the pulse wide modulation dimming control signal according to said backlight source dimming coefficient;

driving the backlight source by using the pulse wide modulation dimming control signal.

8. The processing method of high dynamic contrast for liquid crystal display apparatus according to claim 5, characterized in that said controlling the voltage of the pixel capacitor on the liquid crystal panel according to said Gamma reference voltage parameter is that:

converting the Gamma reference voltage parameter into a bus format;

generating the Gamma reference voltage according to the Gamma reference voltage parameter in the bus format;

transmitting the Gamma reference voltage to a source driving IC and generating the voltage of the pixel capacitor by the source driving IC.

9. A processing device of high dynamic contrast for liquid crystal display apparatus according to claim 2, characterized in that it further comprises;

a frame buffer, for receiving and storing the data subjected to the format conversion; and a transmitter, for reading data from said frame buffer, and transmitting it to said source driving IC.

10. The processing device of high dynamic contrast for liquid crystal display apparatus according to claim 3, characterized in that it further comprises:

a frame buffer, for receiving and storing the data subjected to the format conversion; and a transmitter, for reading data from said frame buffer, and transmitting it to said source driving IC.

* * * * *